US006431901B1

(12) United States Patent
Yeh

(10) Patent No.: US 6,431,901 B1
(45) Date of Patent: Aug. 13, 2002

(54) I/O CONNECTOR HAVING AN INTERNAL HORIZONTAL PCB

(75) Inventor: Joel J. Yeh, San Gabrie, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/955,425

(22) Filed: Sep. 10, 2001

(51) Int. Cl.[7] ..... H01R 13/54
(52) U.S. Cl. ..... 439/357; 439/188
(58) Field of Search ..... 439/358, 357, 439/352, 350, 353, 188

(56) References Cited

U.S. PATENT DOCUMENTS 5,749,746 A * 5/1998 Tan et al. ..... 439/357
5,797,771 A * 8/1998 Gravside ..... 439/610
6,254,417 B1 * 7/2001 Pan ..... 439/357
6,257,914 B1 * 7/2001 Comerci et al. ..... 439/357

* cited by examiner

*Primary Examiner*—Hien Vu
(74) *Attorney, Agent, or Firm*—Wei Te Chung

(57) ABSTRACT

An I/O connector includes a top cover (10), a bottom cover (20) coupling to the top cover, a terminal module (30) positioned between the bottom cover and the top cover and receiving a plurality of terminals (90) therein, and a PCB (40) horizontally soldered to solder portions of the terminals. The top cover has a latch release button (11) at a front end thereof and a press button (12) in a middle portion thereof, a pair of stand poles (15) being formed under the latch release button. A pushbutton switch (50) is soldered on the PCB and engaged with the press button of the top cover. A latch piece (60) is assembled to the terminal module and has a pair of upstanding ear portions (64) over the terminal module for engaging the stand poles and a pair of hooks (63) extending out for engaging a mating connector.

7 Claims, 7 Drawing Sheets

I/O CONNECTOR HAVING AN INTERNAL HORIZONTAL PCB

FIELD OF THE INVENTION

The present invention relates to an input/output (I/O) connector for a portable communication device, and more particularly to an I/O connector for personal digital assistant (PDA).

BACKGROUND OF THE INVENTION

Portable communications devices, such as cellular telephones, pagers, PDAs, etc., have become ubiquitous in recent years. Being portable, such devices frequently need to be charged, or connected to another device, such as a personal computer (PC) to upload or download information. The portable communications device is connected to an external device via an I/O connector. U.S. Pat. No. 6,071,141 discloses an I/O connector including a top cover, a bottom cover coupled to the top cover, a terminal module which has a plurality of terminals received in position between the top cover and the bottom cover, and a pair of latch arms formed integral with the bottom cover. However, a conventional I/O connector for PDA further includes a printed circuit board (PCB) and a pushbutton switch soldered on the PCB for intermitting or starting data transfer. The PCB is vertical to the top cover and the bottom cover. The terminals received in the terminal module are soldered to the PCB by surface mount technology (SMT).

However, in this design, it is difficult to handle the terminals to be connected to the PCB. Also, since the PCB is vertical to the top cover and the bottom cover, and with a view that I/O connector should be of low profile as possible, the area of the PCB is too small to permit or expand other functions.

Hence, an improved I/O connector is required to overcome the disadvantages of the prior art.

BRIEF SUMMARY OF THE INVENTION

A main object of the present invention is to provide an 1/O connector with terminals are easily handled to PCB thereof.

Another object of the present invention is to provide an I/O connector with a PCB having broader area for extending extra functions.

To fulfill the above-mentioned objects, according to a preferred embodiment of the present invention, an I/O connector includes a bottom cover, a top cover coupling to the bottom cover, a terminal module having a plurality of terminals between the bottom cover and the top cover, and a PCB horizontally soldered to solder portions of the terminals. A pushbutton switch is soldered on the PCB. A latch piece assembles in the terminal module with a pair of hooks thereof extending out of a front end of the I/O connector and a pair of upstanding ear portion extending over the terminal module. The top cover has a press button located in the middle and a latch release button at a front end thereof. A pair of stand poles are formed under the latch release button. A metal plate is secured to and under the top cover. The stand poles traverse the metal plate to engage with the ear portions. The press button traverses the metal plate to engage with a pushbutton switch. The I/O connector further includes a strain relief at a rear end thereof for securing a cable. The I/O connector is released from a mating connector by pressing the latch release button.

In this design, the PCB is positioned in horizontal, it is easy to handle the terminals to be connected to the PCB by SMT. Further more, the area of the PCB is larger than prior designs to permit or expand extra functions, for example, light-emitting diode (LED) display.

Other objects, advantages and novel feather of the invention will become more apparent from the following detailed description when taken in conjunction with the accompanying drawings.

DETAILED DESCRIPTION OF THE INVENTION

Figure 1:
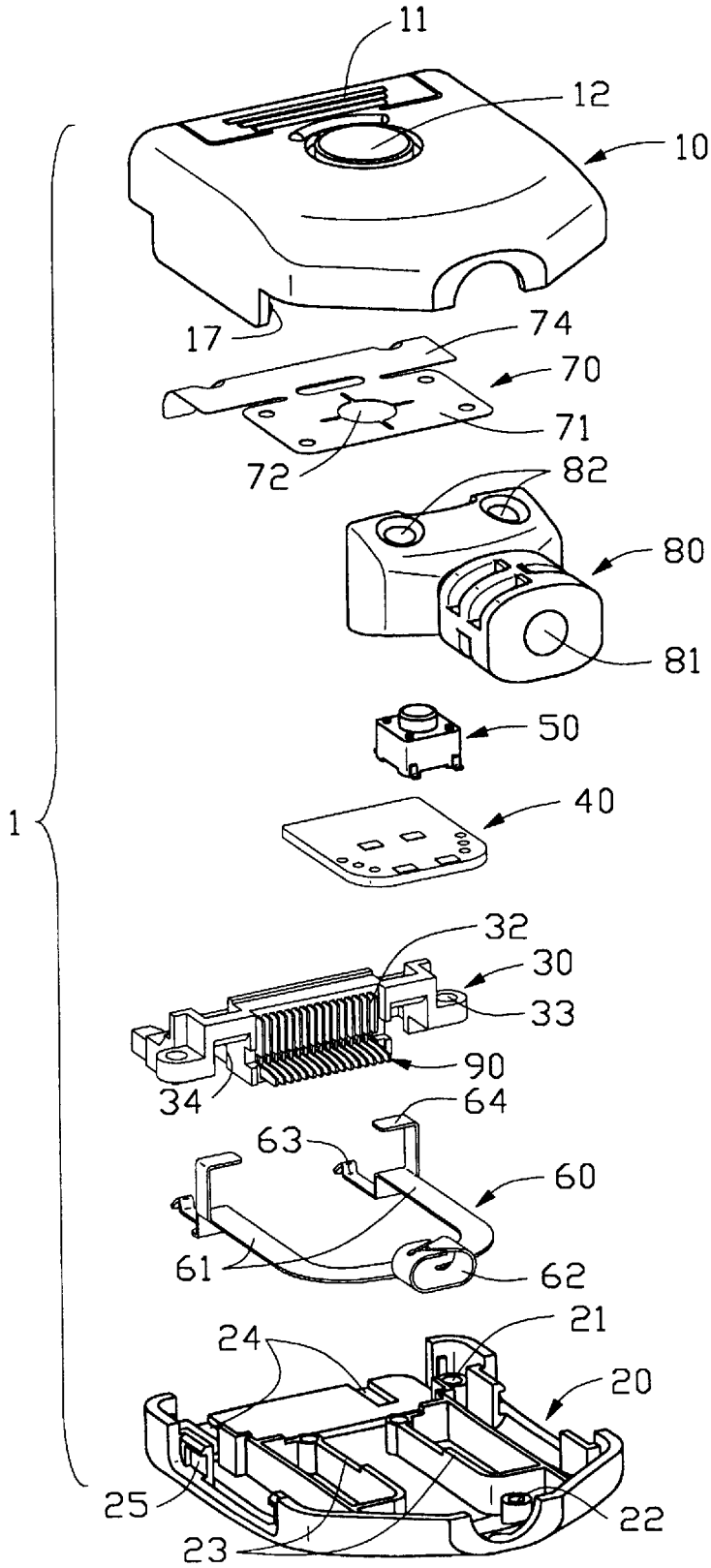
FIG. 1 is an exploded view of an I/O connector according to the present invention.
Figure 2:
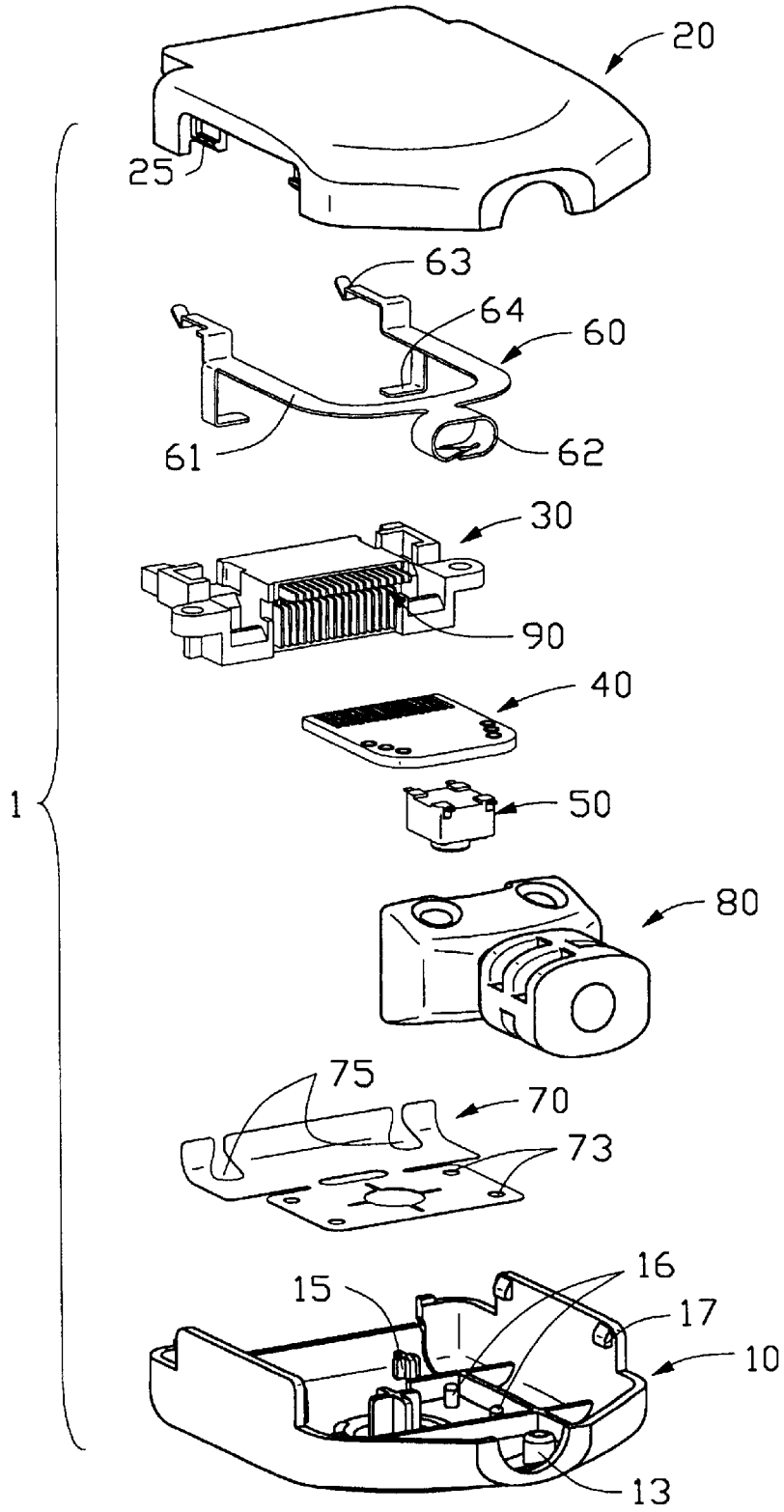
FIG. 2 is a view taken from an opposite angle of FIG 1.

Referring to FIGS. 1 and 2, an I/O connector 1 in accordance wit h the present invention comprises a top cover 10, a bottom cover 20, a terminal module 30 with a plurality of terminals 90 received therein, a PCB 40 with a pushbutton switch 50 soldered thereon, a latch piece 60, a metal plate 70, and a strain relief 80.

The top cover 10 has a latch release button 11 at a front end thereof and a press button 12 located in the Middle portion thereof. A pair of stand poles 15 extends downwardly from a lower surface of the latch release button 11. Four fixed poles 16 distribute around the press button 12 on a lower surface of the top cover 10. A pair of upper poles 13 stands from a lower surface of the top cover 10 at a rear end thereof. The top cover 10 further defines a pair of barbs 17 on each side.

The bottom cover 20 defines a pair of the bracket 23 in the middle. A pair of lower holes 21 are formed adjacent to a front end of the brackets 23. The bottom cover 20 further defines and a pair of channels 24 at a front end and a pair of lower poles 22 at a rear end thereof. Corresponding to the barbs 17, a pair of notches 25 formed on each side of the bottom cover 20.

The terminal module 30 defines a plurality of passageways 32 for receiving the terminals 90. Corresponding to the lower holes 21, the terminal module 30 defines a pair of upper holes 33 on two sides thereof. In addition, the terminal module 30 defines a pair of grooves 34 adjacent to the upper holes 33. The grooves 34 run front-to-rear through the terminal module 30 and come out of a top surface thereof.

The latch piece 60 includes a pair of connecting arms 61 and a collar 62 position at the joint point of the connecting arms 61. A pair of hooks 63 extends frontward from the free end of the connecting arms 61. A pair of ear portions 64 neighboring to the hook 63 extends perpendicular to the connecting arms 61.

The metal plate 70 includes a base portion 71 with a central hole 72 and a bending portion 74. Corresponding to the fixed poles 16, the base portion 71 defines four fix holes 73 around the central 72. The bending portion 74 defines a pair of slots 75 to permit the stand poles 15 pass through.

The strain relief 80 has a passage 81 through front-to-rear for receiving an end of a cable and a pair of holes 82 through top-to-bottom corresponding to the upper poles 13 and the lower poles 22.

Figure 3:
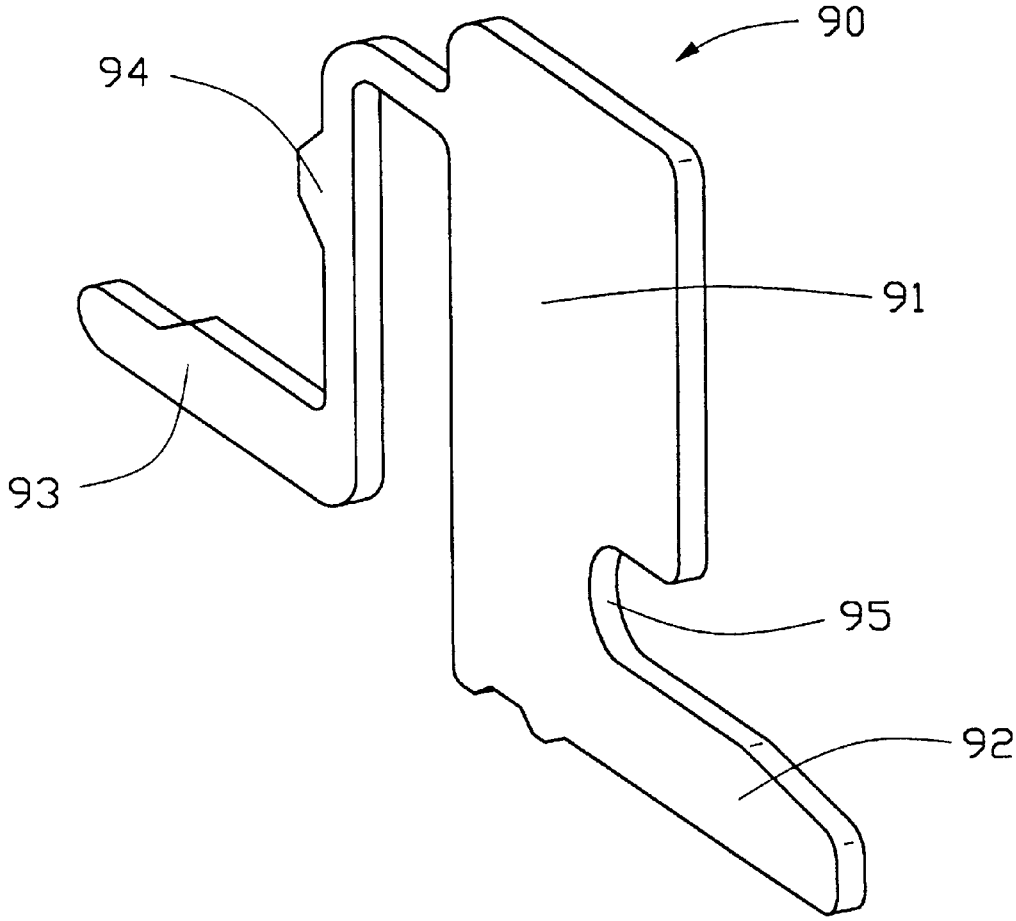
FIG. 3 is a perspective view of terminal.

Referring to FIG. 3, each terminal 90 includes a base portion 91 and a solder portion 92 extended rearward from a rear end thereof. A concave 95 formed at the joint of the base portion 91 and the solder portion 92. A contact portion 93 extends frontward from a front end of the base portion 91 and away from the solder portion 91. The contact portion 93 connects to the base portion 91 via a spring portion 94 which can cushion the force the contact portion 93 received from a mating connector.

Figure 4:
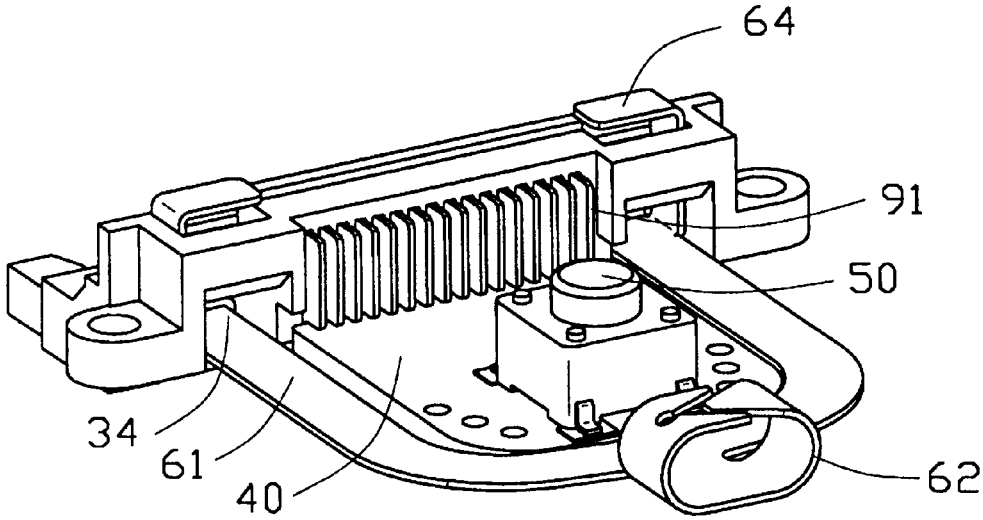
FIG. 4 is an assembled view of several elements of the r/O connector.
Figure 6:
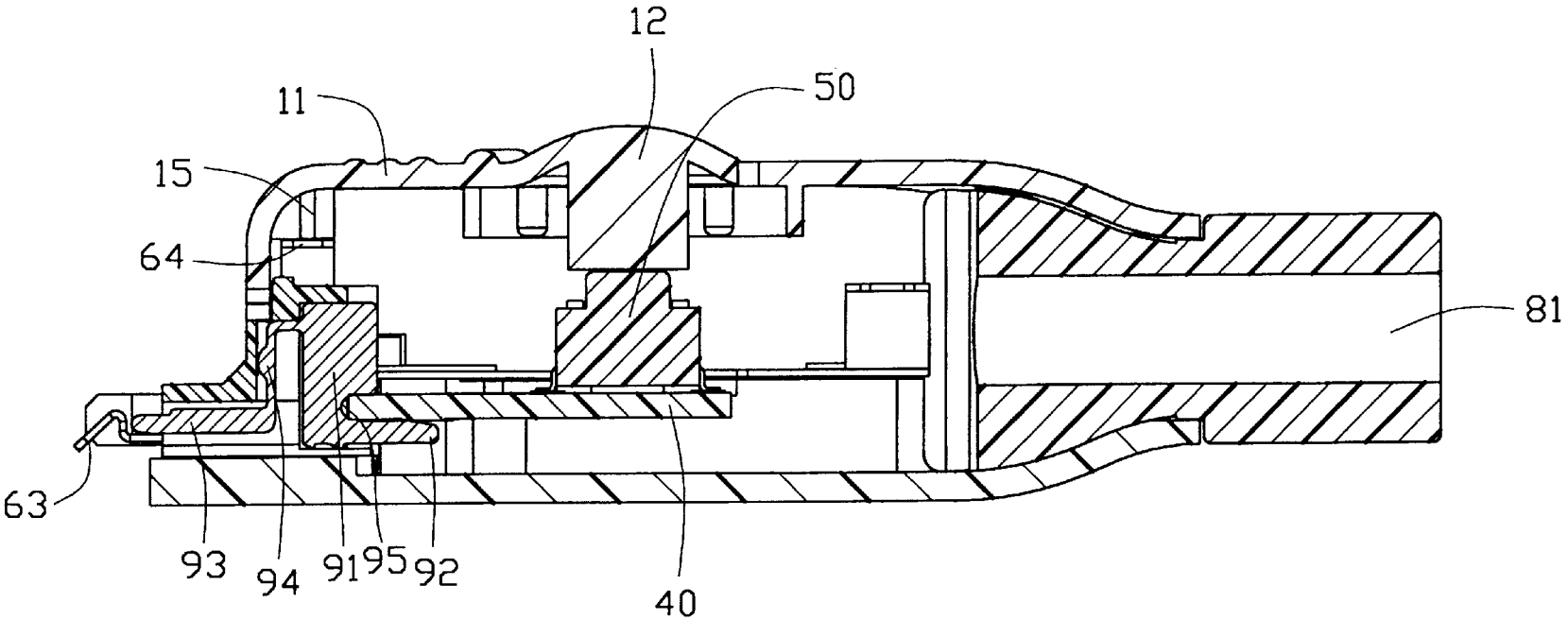
FIG. 6 is a cross-section view of the I/O connector taken along line 6—6 in FIG. 3.

In assembly, referring to FIG. 4, the base portions 91 of the terminals 90 received in the passageways 32 of the terminal module 30 with the solder portions 92 extending horizontally out of the rear end of the terminal module 32 (referring to FIG. 6). The PCB 40 with the pushbutton switch 50 soldered on is positioned on the solder portions 92 of the terminals 90 and a free end of the PCB 40 blocked in the concave 95 for firmly position the PCB 40. The free end of the connecting arms 61 received in the grooves 34 with the hooks 63 extending out of the front end of the terminal module 30 and the ear portions 64 running through the grooves 34 to stand over the terminal module 30.

Figure 5:
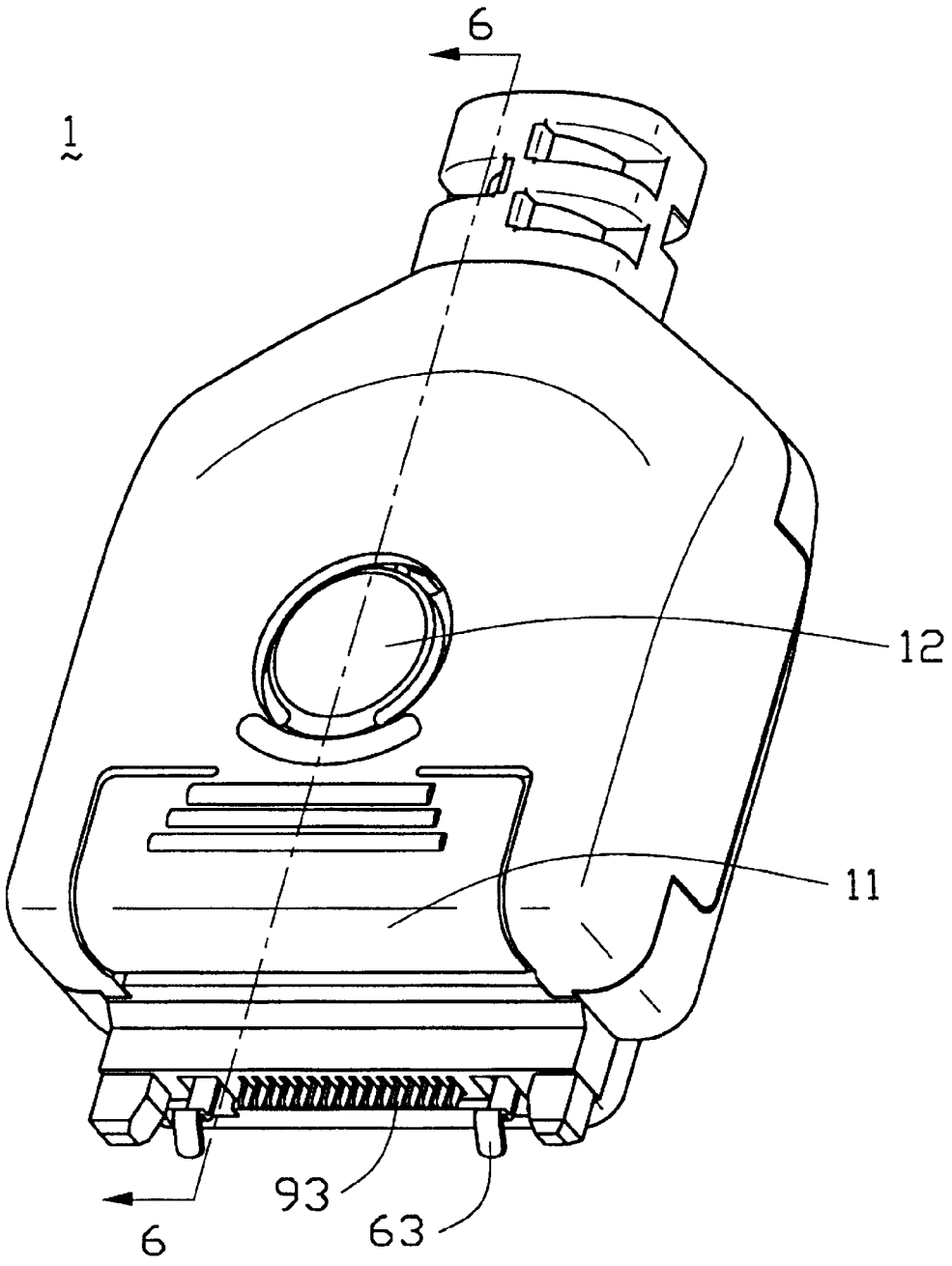
FIG. 5 is an assembled view of the I/O connector.

Referring to FIGS. 5 and 6, the top cover 10 firmly couples to the bottom cover 20 by the corporation of the barbs 17 and the notches 25. The terminal module 30 firmly positioned between the top cover 10 and the bottom cover 20 by inserting a pair bolts or poles (not shown) in the upper holes 33 and the lower holes 21. The PCB 40 positioned on the brackets 23 and parallels to the top cover 10 and the bottom cover 20. The connecting arms 61 positioned on the a brackets 23 also. The hooks 63 run through the channels 24 and extend out of the front end of the I/O connector 1. The metal plate 70 is secured to and under the top cover 10 with the fixed holes 73 positioned on the fixed poles 16. The stand poles 15 traverse the slots 75 to engage with the ear portions 64 of the latch piece 60. The press button 12 traverses the central hole 72 to engage with the pushbutton switch 50.

Figure 7:
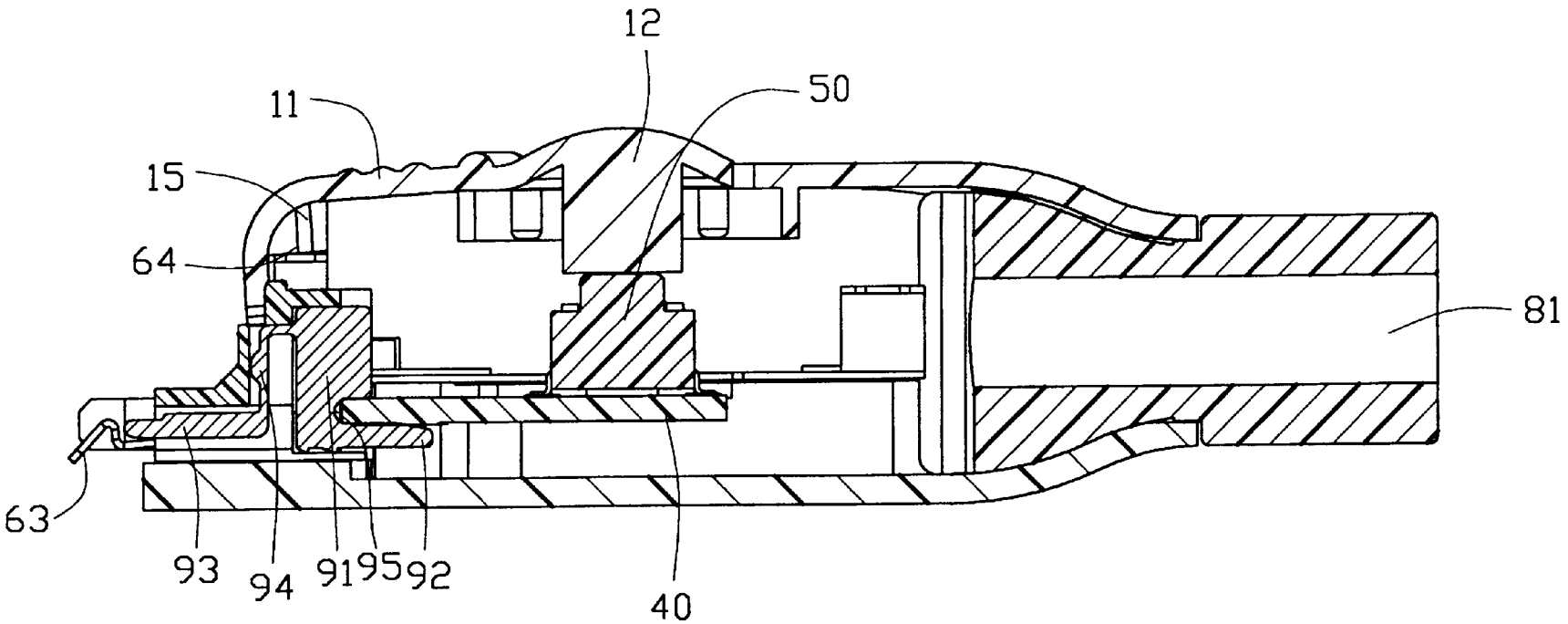
FIG. 7 is a cross-section view of the I/O connector when the latch release button being pressed.

Referring to FIG. 7, when a force put on the latch release button 11, the stand poles 15 downwardly press the ear portions 64 which cause the hooks 63 downwardly move thereby the I/O connector 1 can release from the mating connector, while the bending portion 74 will move downwardly with the latch release button 11. When the force disappear, the latch release buttons 11 will revert to the normal station via the springiness of the bending portion 74, while the ear portions 64 and the hooks 63 will revert to the normal station also.

In addition, the strain relief 80 positioned between the top cover 10 and the bottom cover 20 at a rear end thereof for securing a cable, while the holes 82 positioned on the upper poles 13 and the lower poles 22.

Since the PCB 40 positioned in horizontal, it is easy to handle the terminals 31 to be connected to the PCB 40 and solder by SMT. Furthermore, the area of the PCB 40 is so broader than prior to permit or expands extra functions, for example, light-emitting diode (LED) display.

It is to be understood, however, that even though numerous, characteristics and advantages of the present invention have been set forth in the foregoing description, together with details of the structure and function of the invention, the disclosed is illustrative only, and changes may be make in detail, especially in matters of shape, size, and arrangement of parts within the principles of the invention to the full extent indicated by the broad general meaning of the terms in which the appended claims are expressed.

What is claimed is:

1. An I/O connector comprising:

a top cover having a latch release button at a front end thereof and a press button in a middle portion thereof, a pair of stand poles being formed under the latch release button;

a bottom cover coupled to the top cover;

a terminal module including a plurality of passageways and being positioned between the bottom cover and the top cover;

a plurality of terminals each having a base portion received in a corresponding passageway and a horizontally extending solder portion;

a PCB being horizontally soldered to the solder portions of the terminals;

a pushbutton switch soldered on the PCB and engaging the press button of the top cover; and a latch piece assembled to the terminal module and having a pair of upstanding ear portions over the terminal module for engaging the stand poles and a pair of hooks extending out for engaging a mating connector; wherein the pushbutton switch and the solder portions of the terminals are located on two opposite sides of the PCB respectively; wherein a metal plate is secured to and under the top cover for providing a reverting force to the latch release button; wherein the metal plate includes a bending portion having a pair of slots and abutted under the latch release button, the stand poles extending through the slots to engage the ear portions of the latch piece.

2. The I/O connector according to claim 1, wherein the terminals are surface mounted to the PCB.

3. The I/O connector according to claim 1, wherein the metal plate includes a base portion with a central hole, the press button extending through the central hole to engage the pushbutton switch.

4. The I/O connector according to claim 1, wherein the latch piece includes a pair of connecting arms, the hooks horizontally extending from the connecting arms.

5. The I/O connector according to claim 4, wherein the ear portions extend perpendicular to the connecting arms.

6. The I/O connector according to claim 5, wherein the latch piece further includes a collar positioned at the joint point of the connecting arms for securing a cable.

7. The I/O connector according to claim 6, wherein the terminal module further defines a pair of grooves, free ends of the connecting arms of the latch piece being received in the grooves with the hooks extending out of a front end of the terminal module and the ear portions extending out of the grooves.

* * * * *